US008590640B2

(12) United States Patent
Haughom

(10) Patent No.: US 8,590,640 B2
(45) Date of Patent: Nov. 26, 2013

(54) APPARATUS AND METHOD TO MAINTAIN CONSTANT FLUID CIRCULATION DURING DRILLING

(75) Inventor: Per Olav Haughom, Tonstad (NO)

(73) Assignee: Baker Hughes Incorporated, Houston, TX (US)

( * ) Notice: Subject to any disclaimer, the term of this patent is extended or adjusted under 35 U.S.C. 154(b) by 345 days.

(21) Appl. No.: 12/673,426

(22) PCT Filed: Aug. 14, 2008

(86) PCT No.: PCT/NO2008/000291

§ 371 (c)(1),
(2), (4) Date: Jun. 11, 2010

(87) PCT Pub. No.: WO2009/022914

PCT Pub. Date: Feb. 19, 2009

(65) Prior Publication Data

US 2010/0252272 A1 Oct. 7, 2010

(30) Foreign Application Priority Data

Aug. 15, 2007 (NO) ..... 20074187

(51) Int. Cl.
*E21B 21/01* (2006.01)

(52) U.S. Cl.
USPC ..... 175/218; 175/214; 166/95.1

(58) Field of Classification Search
USPC ..... 175/218, 214, 215, 232, 317, 318; 166/81.1, 90.1, 95.1
See application file for complete search history.

(56) References Cited

U.S. PATENT DOCUMENTS

| | | | | |
|---|---|---|---|---|
| 2,158,356 | A | 5/1939 | Dyer | |
| 3,298,325 | A | 1/1967 | Meath et al. | |
| 4,293,163 | A * | 10/1981 | Braddick | 251/283 |
| 4,646,844 | A | 3/1987 | Roche et al. | |
| 6,263,981 | B1 | 7/2001 | Gonzalez | |
| 6,401,823 | B1 | 6/2002 | Gonzalez et al. | |
| 7,107,875 | B2 | 9/2006 | Haugen et al. | |
| 7,806,203 | B2 | 10/2010 | Krueger et al. | |
| 2004/0159467 | A1 | 8/2004 | Ayling | |
| 2006/0060360 | A1 | 3/2006 | Moncus et al. | |

(Continued)

FOREIGN PATENT DOCUMENTS

| | | |
|---|---|---|
| GB | 2 427 217 | 10/2008 |
| WO | 2005/019596 | 3/2005 |

(Continued)

OTHER PUBLICATIONS

International Search Report issued Nov. 17, 2008 in corresponding International Application No. PCT/NO2008/000291.

*Primary Examiner* — David Andrews
*Assistant Examiner* — Richard Alker
(74) *Attorney, Agent, or Firm* — Mossman, Kumar & Tyler, PC

(57) ABSTRACT

An apparatus for maintaining constant circulation of drilling fluid includes a valve section (5) at the top of each section of drill pipes to be connected to or removed from the drill string. The valve section (5) has a top inlet for axial circulation and a side inlet (5*b*) for radial circulation. Two separate valves (5*c*, 5*d*) within the valve section controls flow through the inlets. An external valve control device (4) has a circulation adapter (4*b*) for connecting drill fluid at operational pressure to the side inlet (5*b*) and separate activating adapters (4*c*, 4*d*) connecting to the couplings for opening or closing the valves (5*c*, 5*d*).

8 Claims, 4 Drawing Sheets

(56) References Cited

U.S. PATENT DOCUMENTS

| | | | | |
|---|---|---|---|---|
| 2006/0118335 | A1* | 6/2006 | Belik | 175/57 |
| 2006/0254822 | A1 | 11/2006 | Ayling | |
| 2006/0278434 | A1 | 12/2006 | Calderoni et al. | |
| 2009/0025930 | A1* | 1/2009 | Iblings et al. | 166/244.1 |
| 2009/0205838 | A1* | 8/2009 | Springett | 166/380 |
| 2010/0155143 | A1 | 6/2010 | Braddick | |
| 2010/0300543 | A1 | 12/2010 | Braddick | |
| 2011/0203670 | A1 | 8/2011 | Braddick | |

FOREIGN PATENT DOCUMENTS

| | | | |
|---|---|---|---|
| WO | 2005/080745 | | 9/2005 |
| WO | 2006/133826 | | 12/2006 |
| WO | 2008156376 | A1 | 12/2008 |

* cited by examiner

APPARATUS AND METHOD TO MAINTAIN CONSTANT FLUID CIRCULATION DURING DRILLING

BACKGROUND OF THE DISCLOSURE

The invention regards an apparatus and method to maintain constant fluid circulation during the entire drill process.

Drilling fluids ("mud") are complex mixtures based on water or oil used to stabilize the borehole when drilling for oil, and to transport solid material, cuttings, to the surface. Water based drilling fluid is treated, cuttings are removed by separation, and the water is re-circulated to a large extent. Oil based drilling fluids are disposed of, re-circulated after treatment or used for heating oil.

The drilling fluid is circulated continuously. When a new section of drilling pipes is connected to ("makeup") or disconnected from ("breakout") the top of a string of pipes, the circulation of drilling fluid must be maintained. If circulation stops, the drilling fluid will settle, acquire a jelly-like form, and require a large pressure to resume the circulation. This may lead to a punctured formation, which collapses, and large losses of drilling fluid into the formation.

When drilling through reservoirs or formations having small margins between fracturing gradient and pore pressure, it is of great importance that the pressure at the bottom of the bore, measured by Equivalent Circulation Density (ECD), is maintained within small margins. Starting and stopping mud pumps creates pressure changes which may exceed these margins.

ECD (Equivalent Circulation Density) depends on factors like:

mud weight
type and composition of mud
temperature
circulation rate
gel strength.

In a typical drilling operation, drill pipes of different sizes are used depending on several factors. The drill pipes are typically 9.3 m long, and are threaded together into stands, each stand having three drill pipes. When inserting or withdrawing a string of drill pipes, stands or single drill pipes must be connected to or disconnected from the string of drill pipes. This means that during circulation, the mud pumps must be stopped and started when pipes are connected or disconnected. Start and stop causes pressure changes mentioned above, resulting in formation fractures and losses. This constitutes a large risk regarding well security, and additionally a large economic cost, as it may lead to loss of the entire section or the entire well.

All the factors and conditions above are important in wells classified as:

HTHP—High Temperature High Pressure
UBD—Under Balanced Drilling.
ERD—Extended Reach Drilling Thus, it is important to maintain continuous circulation of drilling fluid during the entire drilling operation.

GB 2.427.217-A (corresponding to WO A1 2006133826, ENI) discloses a short tubular section (a valve section) having two valves. The section is threaded at both ends, and is included in a drill string. One valve is connected to an external coupling, and is used for opening or closing a radial inlet for drilling fluid. The second valve is operated by pressure, and is used for opening or closing a top inlet for flow of drilling fluid axially along the valve section. A larger pressure at the top inlet opens the axial valve, and a larger pressure at the radial side inlet closes the axial valve. When pipes are connected or disconnected, the top inlet is closed, and drilling fluid circulates through the radial inlet. The radial inlet may, if needed, be secured by a plug. In a preferred embodiment, one or both valves are flapper valves. One problem with this device, is that the pressures required to open or close the axial pressure activated valve may exceed the permitted pressure limits. A second problem with this device, is that any pressure operated valve needs a surface on which the pressure may work. A surface extending radially into the central bore to allow opening or closing of the axial valve can make it difficult or impossible to pass certain tools through the central bore.

U.S. Pat. No. 7,107,875 B2 (Haugen et al) also discloses an apparatus that permits sections of pipes to be connected to or disconnected from a string of pipe during a drilling operation. The apparatus allows for the continuous fluid flow to and through the tubular string during makeup and breakout, Rotation and axial movement of the tubular string is alternately provided by a top drive and a rotary drive. Continuous fluid flow into the tubular string is provided through the circulation device and alternately through the main bore once a connection is made between an upper pipe connected to the top drive mechanism and the string of pipe. The circulation device of U.S. Pat. No. 7,107,875 comprises an upper chamber with an opening for the upper pipe, a lower chamber with an opening for the string of pipes, and a gate apparatus between the upper and lower chambers. The gate apparatus is open during connection and disconnection of pipes, and closed when a new section is prepared for or removed from the string of pipes. One problem with this device is that it requires two drives, i.e. a top drive and a rotary drive. Another problem is that drill pipes rotates in holes through the roof of the upper chamber and in the floor of the lower chamber when an upper stand or section of drill pipes are connected to or disconnected from a lower string of pipes, and when the chamber is pressurized. The need for rotating pipes in apertures as described above makes it difficult to adapt the device for high-pressure applications.

WO 2005/080745 (Statoil) discloses a hollow, cylindrical body (a valve section) having a mud inlet in a sidewall, and a valve which in a first position closes the side inlet and opens for fluid flow between the ends of the body, and which in a second position prevents fluid flow between the ends of the body and permits a flow from the side inlet to the lower end of the body. A major problem with this device is an increased risk for pressure shocks when the valve element is rotated. A state in which the valve is briefly allowing a lesser rate of fluid may cause a shock in high pressure applications. Another problem which may occur in high pressure applications, is that a high axial pressure may suddenly switch the valve to a position where the flow is along the central bore of the section which is to be included in the drill string. The problem is that special care must be taken to avoid the situations above, and the resulting pressure shocks in the drill string. This means the device will have problems in high pressure applications, either through an increased risk for pressure pulses, or through expensive correction means.

WO 2005/019596 (Coupler Developments) discloses a cylindrical body (diverter sub) having a valve which can be rotated to a first position in order to open for fluid flow through a top inlet and axially through the central bore, and to a second position to open for fluid flow through a radial side inlet. FIG. 11 shows an embodiment having two valves, in which an upper valve opens to drain the diverter sub or upper tubular before disconnecting it, and in which a lower valve closes the stream of drilling fluid through a top inlet while simultaneously opening for a flow of drilling fluid through a side inlet. The device in WO 2005/019596 can be designed with a bore of substantially equal diameter along the length thereof to allow passage of wireline tools. The problems of the device having one valve are similar to the problems associated with the Statoil device. The second valve of FIG. 11 is provided to drain the upper section of drill pipe. Thus, it is a valve of a different making provided for another purpose than the second valve of the present invention. Specifically, it does not provide a solution to the problems associated with high pressure applications.

NO168262 B (Hydril) shows a diverter sub that can be used as a blow out preventer. This device provides an apparatus of a different design to solve a different problem, and is cited as technical background.

The international company National Oilwell Varco has developed a system enabling continuous circulation of drilling fluid when sections of drill pipes are connected to, or disconnected from, a string of drill pipes This system is called "CCS-9-5k Continuous Circulation System", and is a commercially available product used in the international market. This system is quite complicated, and may require a rebuild of part of the drilling floor and the areas around it. This is costly, a logistic challenge, and a time consuming process. The system replaces, among other things, the BlowOut Preventer (BOP), the iron roughneck and a possible snubbing unit. The main problems of this device are complexity and the required modifications of the rig.

US A1 20060254822, U.S. Pat. No. 3,298,325 and U.S. Pat. No. 2,158,356 disclose solutions for maintaining continuous fluid circulation in a well when drill pipes are connected to or disconnected from a string of drill pipes. These are cited as technical background.

SUMMARY OF THE DISCLOSURE

The invention employs specially designed circulation valves, which are tested and verified to give a more robust construction fit for the high pressures and powerful vibrations which occur in drilling conditions as described above. This ensures that the functionality is intact when the valves are retracted from the well, and are to be reused in a new sequence. A circulation valve having a smooth central bore is better protected against external influence, like erosion during circulation and foreign material. The circulation valves must withstand fluid pressures up to 1600 bar. At such pressures, flapper valves are hardly usable. In addition, flapper valves are limited in that they do not provide a clean inner diameter without restrictions to permit passage of tools for different purposes.

The present invention concerns an apparatus and method as disclosed in the characterizing parts of the accompanying independent claims.

The apparatus is automatic and operated by remote control. This eliminates potential danger for personnel working in the vicinity of equipment with the pressures involved.

The invention concerns an apparatus and method for maintaining constant pressure at the bottom of the bore hole, independent of:

- drilling
- rotation
- whether sections of pipe are connected to or disconnected from a string of pipes
- mass og removed material
- type and composition of mud
- rate of circulation
- differential pressure The invention reduces the risk when drilling through reservoirs or formations having the above mentioned small margins between fracturing gradient and pore pressure. This will increase security and productivity, and reduce the cost of well drilling.

BRIEF DESCRIPTION OF THE DRAWINGS

The invention will be further described in the following with reference to the accompanying drawings, in which.

DETAILED DESCRIPTION OF THE DISCLOSURE

Figure 1A:
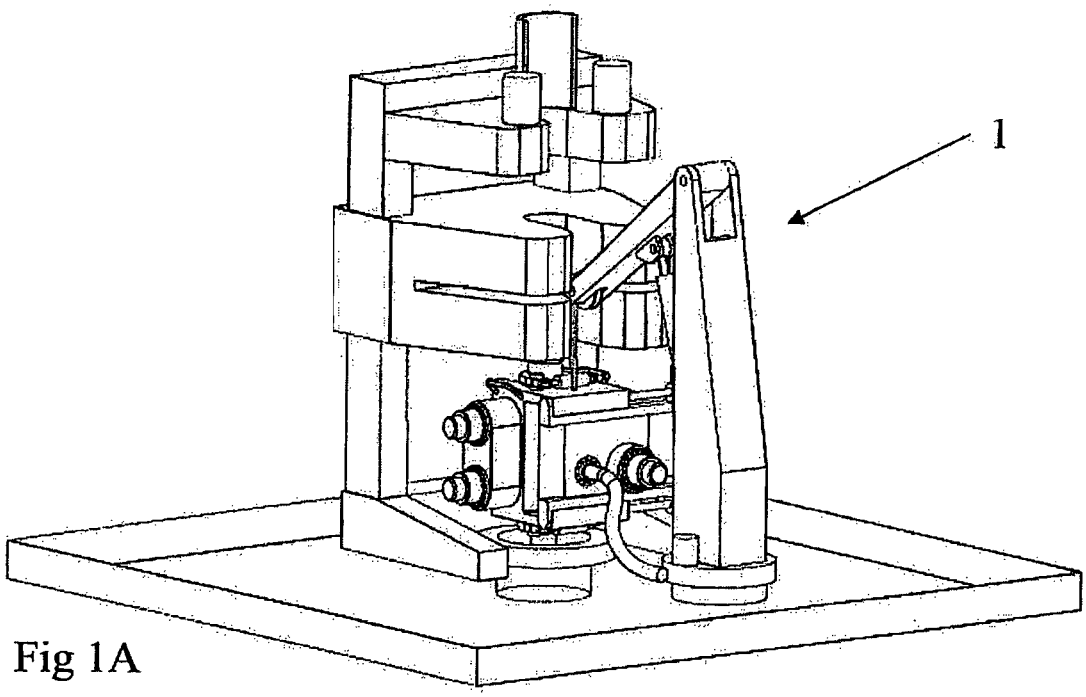
FIG. 1A shows, in 3D, the automatic fluid circulation equipment 1 installed in a drill rig along the usual tool for connecting and disconnecting drill pipes, called an iron rough neck.
Figure 1B:
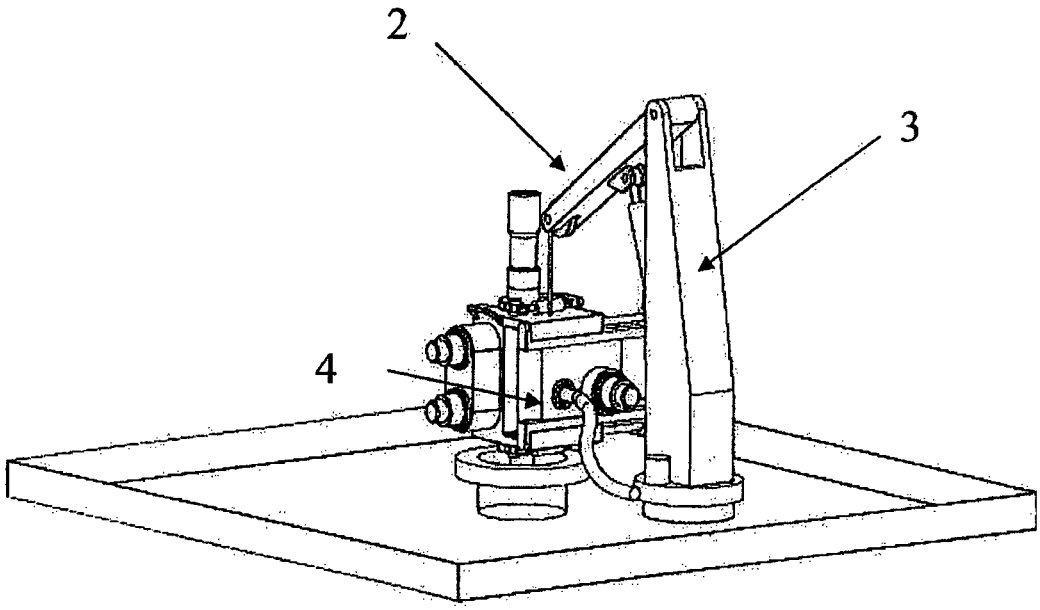
FIG. 1B shows, in 3D, the circulation equipment comprising a rotating base 3 having a hinged arm 2 and a valve control device 4 standing alone on the rig.
Figure 2A:
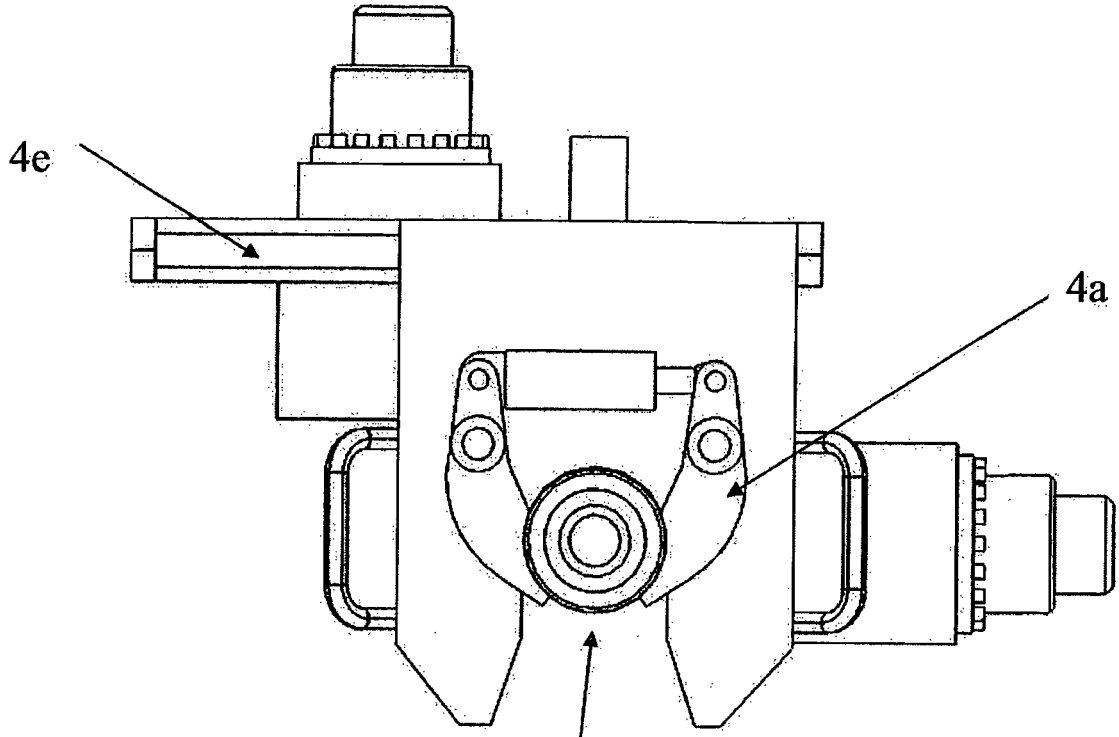
FIG. 2A is a top view of the valve control device 4 gripping a valve section 5.
Figure 2B:
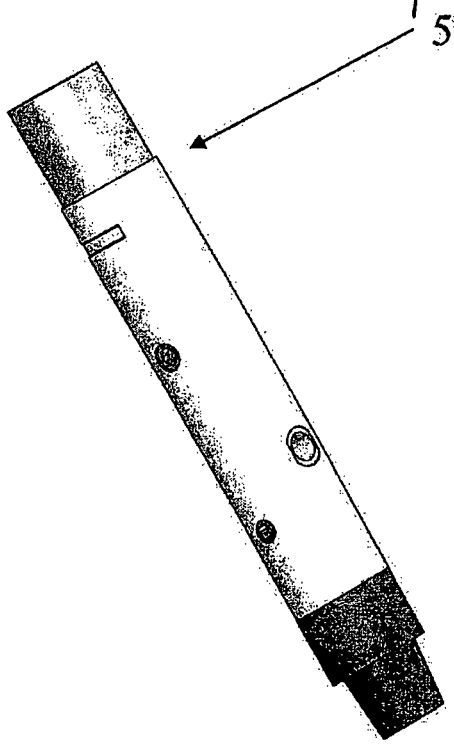
FIG. 2B is a detail of the valve section 5, shown in 3D, in the form it has when connected in a string of pipes in a bore or well. The valve section 5 has inlets for axial and radial circulation.
Figure 3A:
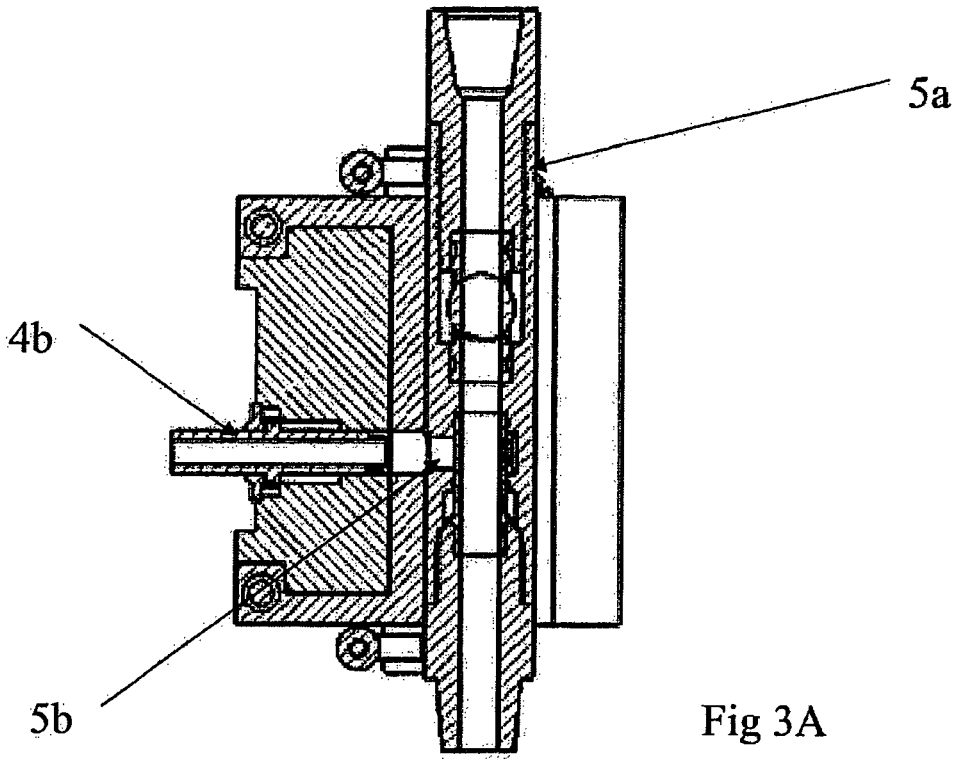
FIGS. 3A and 3B shows the valve section 5 with an open top inlet and closed side inlet.
Figure 3B:
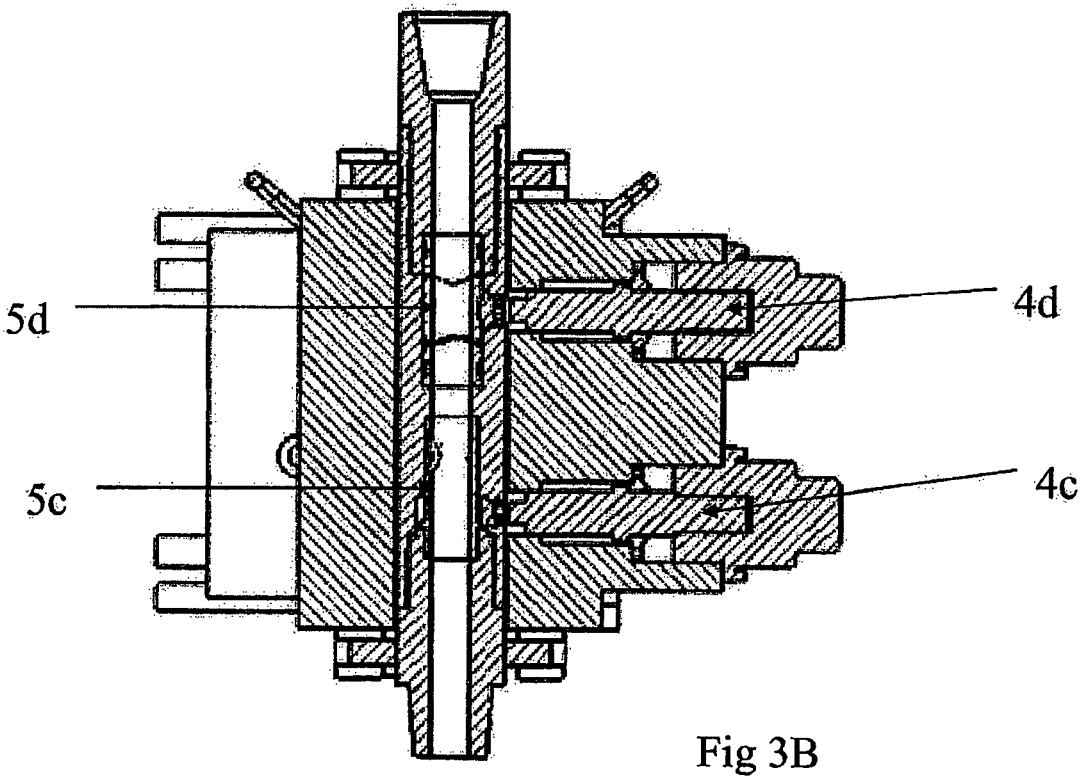
Figure 4A:
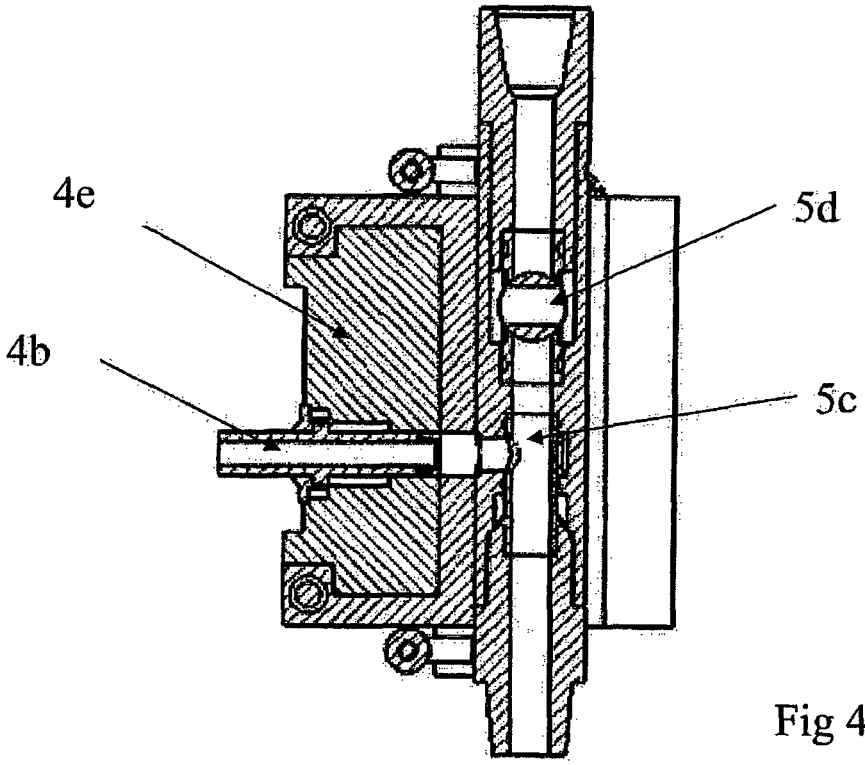
FIGS. 4A and 4B shows the valve section 5 with a closed top inlet and open side inlet.
Figure 4B:
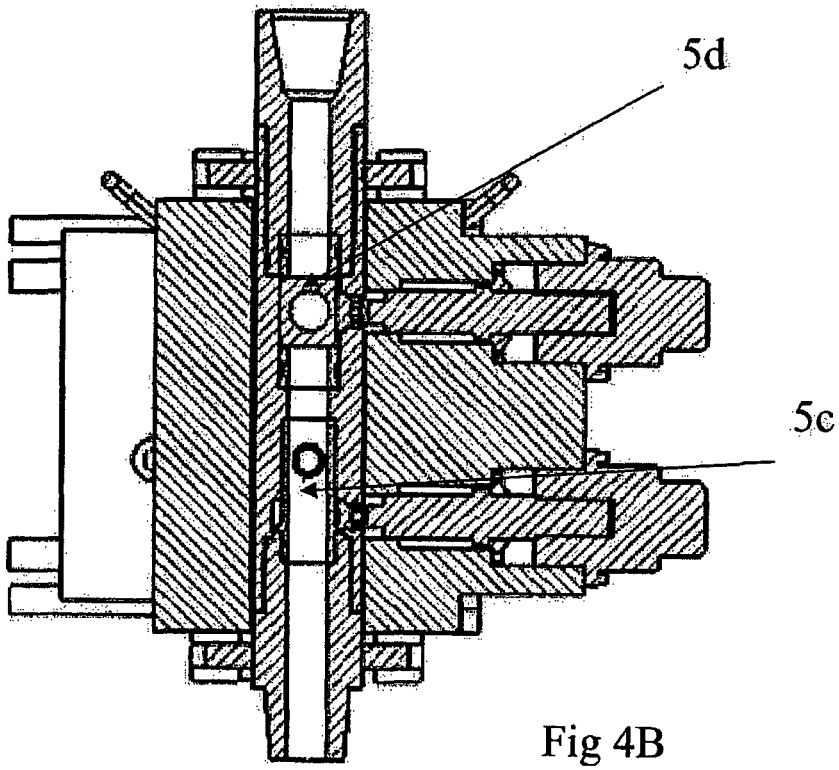

A rotating base 3 having a hinged arm 2 is installed on the floor of a drilling rig, on rails, through a threaded connection or on the tool used for connecting or disconnecting stands to the string of pipes.

A valve control device 4 is provided on the hinged arm 2. A line connects a source for drilling fluid to a circulation adapter 4*b*, such that supply for drilling fluid is ready when the valve section 5 comes into position.

The valve section 5 can be pre-connected to the top of a stand onshore, whereupon the unit is shipped and stored in a storage system for drill pipes on the rig.

A stand is drilled down until it reaches the drill floor. Next, a valve control device 4 is moved adjacent to the valve section 5 using the rotating base 3 and hinged arm 2 which may be operated by remote control by a dedicated person on the drill floor or drill bow. The arm 2 moves the valve control device 4 to and around the valve section 5, activates a valve localizing device 4*a* from the remote control, and positions the valve control device relative to a valve localizing slot 5*a*, whereby the valve control device 4 is disposed concentric around, and locked to, the valve section 5, and ready for use. Drilling fluid is still circulated through the top drive.

Next, a circulation adapter 4*b* is activated from the remote control such that it is inserted into a side inlet 5*b* in the valve section 5. Now, circulation through the valve section 5 may be activated.

Using the circulation adapter 4*b*, the line is pressurized. Thereafter a lower circulation valve 5*c* is activated by remote control via a lower rotation mechanism 4*c*, and the lower circulation valve 5*c* is rotated to an open position where the side inlet 5*b* provides free passage to the central bore of the valve section 5. At this point, drill fluid is circulated through the top drive and through the valve control unit 4 and side inlet 5*b*.

An upper circulation valve 5*d* is activated by remote control, via an upper rotation mechanism 4*d*. The upper valve 5*d* closes the inlet in the upper part of the valve section 5 by means of the coupling tool for drilling pipes. Drilling fluid is at this point circulated only through the side inlet 5*b*, and the upper part of valve section 5 is available for connecting a new stand.

A new stand comprising drill pipes having a valve section 5 on top is connected to the string of drill pipes, and the top drive is fastened to the top of the valve section 5. The coupling tool for drilling pipes is moved aside, and a pressure above the valve section 5 and the upper circulation valve through the top drive is established. The upper circulation valve 5*d* is activated by remote control via the upper rotation mechanism 4*d* to an open position. Circulation is now established through the drill motor (top drive), and the lower circulation valve 5*c* is closed by remote control via the lower rotation mechanism 4*c*. Then, the circulation through the line is stopped, and the circulation adapter 4*b* is activated by remote control and is retracted into the valve control device 4. Thereafter, the lower rotation mechanism 4*c* is rotated, and a security plug is threaded into the side inlet 5*b*. Then the valve localizing device 4*a* is deactivated by remote control, and the valve control device 4 is removed from the valve section 5 by means of the remotely operated arm 2. Now, drilling is resumed until the next stand must be connected to the drill string.

When the string of drill pipes is to be retracted from the well, the procedure is repeated in a similar manner as disclosed above, differing in that stands are disconnected from, rather than connected to, the string of drill pipes.

I claim:

1. An apparatus for use with a drill string formed of jointed tubulars, comprising:

a valve section having a first end and a second end, each end being configured to connect with a jointed tubular of the drill string, the valve section further including a radial side inlet;

an upper circulation valve configured to selectively close the first end;

a lower circulation valve configured to selectively close the radial side inlet;

a valve control device movable into engagement with the valve section, the valve control device including:

an adapter configured to connect to the radial side inlet, a line supplying fluid to the adapter, a first activating adapter configured to activate the upper circulation valve, and a second activating adapter configured to activate the lower circulation valve.

2. The apparatus of claim 1, wherein an outer surface of the valve section includes a first coupling configured to operatively engage the first activating adapter and a second coupling configured to operatively engage the second activating adapter.

3. The apparatus of claim 1, wherein the upper circulation valve is configured to prevent flow into the first end when actuated by the first activating adapter.

4. The apparatus of claim 1, wherein the upper circulation valve has a bore configured to permit passage of a well tool through the valve section.

5. The apparatus of claim 1, wherein engagement of the valve control device with the valve section engages the first activating adapter with the upper circulation valve and the second activating adapter with the lower circulation valve.

6. An apparatus for use with a drill string formed of jointed tubulars, comprising:

a valve section adapted to be connected to a stand of the drill string, the valve section including a side inlet, an upper circulation valve, and a lower circulation valve;

a rotating base having a hinged arm for selectively engaging the valve section, and a valve control device disposed on the hinged arm for engaging the valve section, the valve control device including:

a circulation adapter insertable into the side inlet, a line connecting a source for a drilling fluid to the circulation adapter, a lower rotation mechanism configured to actuate the lower circulation valve to an open position where the side inlet provides free passage to a central bore of the valve section, and an upper rotation mechanism configured to actuate the upper circulation valve to close an inlet in an upper part of the valve section.

7. The apparatus of claim 6, wherein the valve control device further includes a valve localizing device configured to position the valve control device relative to a valve localizing slot associated with the valve section, wherein the valve control device is positioned around and locked to the valve section.

8. The apparatus of claim 6, wherein the lower circulation valve is configured to be remotely activated to circulate fluid into the valve section while the upper circulation valve circulates fluid through the valve section.

* * * * *